US007237878B2

(12) United States Patent
Okubo

(10) Patent No.: US 7,237,878 B2
(45) Date of Patent: Jul. 3, 2007

(54) LIQUID JETTING HEAD

(75) Inventor: Katsuhiro Okubo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/403,519

(22) Filed: Apr. 1, 2003

(65) Prior Publication Data

US 2003/0210308 A1 Nov. 13, 2003

(30) Foreign Application Priority Data

Apr. 1, 2002 (JP) ..... P2002-099337

(51) Int. Cl.
*B41J 2/045* (2006.01)

(52) U.S. Cl. ..... 347/71; 347/70

(58) Field of Classification Search ..... 347/71, 347/72, 70

See application file for complete search history.

(56) References Cited

U.S. PATENT DOCUMENTS

| | | | | |
|---|---|---|---|---|
| 5,266,964 | A * | 11/1993 | Takahashi et al. | 347/72 |
| 5,402,159 | A * | 3/1995 | Takahashi et al. | 347/9 |
| 5,604,522 | A * | 2/1997 | Miura et al. | 347/70 |
| 5,983,471 | A | 11/1999 | Osawa | |
| 2001/0030674 | A1* | 10/2001 | Matsuzawa et al. | 347/70 |

FOREIGN PATENT DOCUMENTS

| | | | |
|---|---|---|---|
| EP | 0 783 965 | A2 | 7/1997 |
| EP | 1 034 931 | A1 | 9/2000 |
| EP | 1 038 675 | A2 | 9/2000 |
| EP | 1 147 899 | A1 | 10/2001 |
| JP | 9-277531 | A | 10/1997 |
| JP | 11-268269 | A | 10/1999 |
| JP | 2001-246744 | A | 9/2001 |
| JP | 3366146 | B2 | 11/2002 |

* cited by examiner

*Primary Examiner*—Julian D. Huffman
(74) *Attorney, Agent, or Firm*—Sughrue Mion, PLLC

(57) ABSTRACT

A vibration plate forms a part of a pressure chamber communicated with a nozzle orifice from which a liquid droplet is ejected. The pressure chamber is defined by first edges extending in a first direction with a first dimension and second edges extending in a second direction substantially perpendicular to the first direction with a second dimension shorter than the first dimension. A piezoelectric vibrator is disposed on the vibration plate so as to oppose to the pressure chamber. The piezoelectric vibrator includes a drive electrode extending beyond one of the second edges, a first piezoelectric layer laminated on the drive electrode so as to extend beyond the second edges, and a first common electrode laminated on the first piezoelectric layer. A drive terminal is electrically connected to the drive electrode to supply a drive signal thereto. The drive terminal is overlaid on one of portions of the first piezoelectric layer where is extended beyond the second edges, while being separated from the first common electrode.

3 Claims, 8 Drawing Sheets

LIQUID JETTING HEAD

BACKGROUND OF THE INVENTION

This invention relates to a liquid jetting head for ejecting a liquid droplet from a nozzle orifice by causing pressure fluctuation to occur in liquid in a pressure chamber as a piezoelectric vibrator becomes deformed.

Liquid jetting heads each for ejecting a liquid droplet from a nozzle orifice by causing pressure fluctuation to occur in liquid in a pressure chamber include a recording head, a liquid crystal jetting head, a color material jetting head, and the like, for example. The recording head is installed in an image recording apparatus such as a printer or a plotter for ejecting ink liquid as ink droplets. The liquid crystal jetting head is used with a display manufacturing apparatus for manufacturing liquid crystal displays. In the display manufacturing apparatus, a liquid crystal ejected from the liquid crystal jetting head is poured into a predetermined grid of a display substrate having a large number of grids. The color material jetting head is used with a filter manufacturing apparatus for manufacturing a color filter, and ejects a color material onto the surface of a filter substrate.

Various types of liquid jetting heads are available, one of which is a liquid jetting head for ejecting liquid droplets by deflecting and deforming piezoelectric vibrators formed on the surface of a vibration plate. This liquid jetting head is made up of an actuator unit including pressure chambers and piezoelectric vibrators and a flow passage unit including nozzle orifices and a common liquid reservoir, for example. In the liquid jetting head, a piezoelectric vibrator on the vibration plate is deformed, whereby the volume of the corresponding pressure chamber is changed for causing pressure fluctuation to occur in liquid stored in the pressure chamber. Using the pressure fluctuation, a liquid droplet is ejected from the corresponding nozzle orifice. For example, the pressure chamber is contracted, whereby liquid is pressurized for pushing out the liquid from the nozzle orifice.

By the way, there is a strong demand for miniaturizing such a liquid jetting head, because the range of uses of the liquid jetting head can be increased as the liquid jetting head is miniaturized. The actuator units are produced, for example, as ceramics are baked. Thus, as the actuator unit is miniaturized, the number of actuator units produced for each lot (for example, from one ceramic sheet) can be increased, leading to cost reduction.

SUMMARY OF THE INVENTION

It is therefore an object of the invention to provide a liquid jetting head having a structure suited for miniaturization.

In order to achieve the above object according to the invention, there is provided a liquid jetting head, comprising:

a vibration plate, which forms a part of a pressure chamber communicated with a nozzle orifice from which a liquid droplet is ejected, the pressure chamber being defined by first edges extending in a first direction with a first dimension and second edges extending in a second direction substantially perpendicular to the first direction with a second dimension shorter than the first dimension;

a piezoelectric vibrator, disposed on the vibration plate so as to oppose to the pressure chamber, the piezoelectric vibrator comprising:

a drive electrode, extending beyond one of the second edges;

a first piezoelectric layer, laminated on the drive electrode so as to extend beyond the second edges; and a first common electrode, laminated on the first piezoelectric layer; and a drive terminal, electrically connected to the drive electrode to supply a drive signal thereto, the drive terminal being overlaid on one of portions of the first piezoelectric layer where is extended beyond the second edges, while being separated from the first common electrode.

Preferably, the piezoelectric vibrator further comprises: a second common electrode, formed on the vibration plate and electrically connected to the first common electrode; and a second piezoelectric layer, interposed between the second common electrode and the drive electrode.

In such a configuration, as the end portion of the drive terminal is overlaid, the size in the longitudinal direction of the piezoelectric vibrator can be reduced accordingly, so that head miniaturization can be accomplished.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
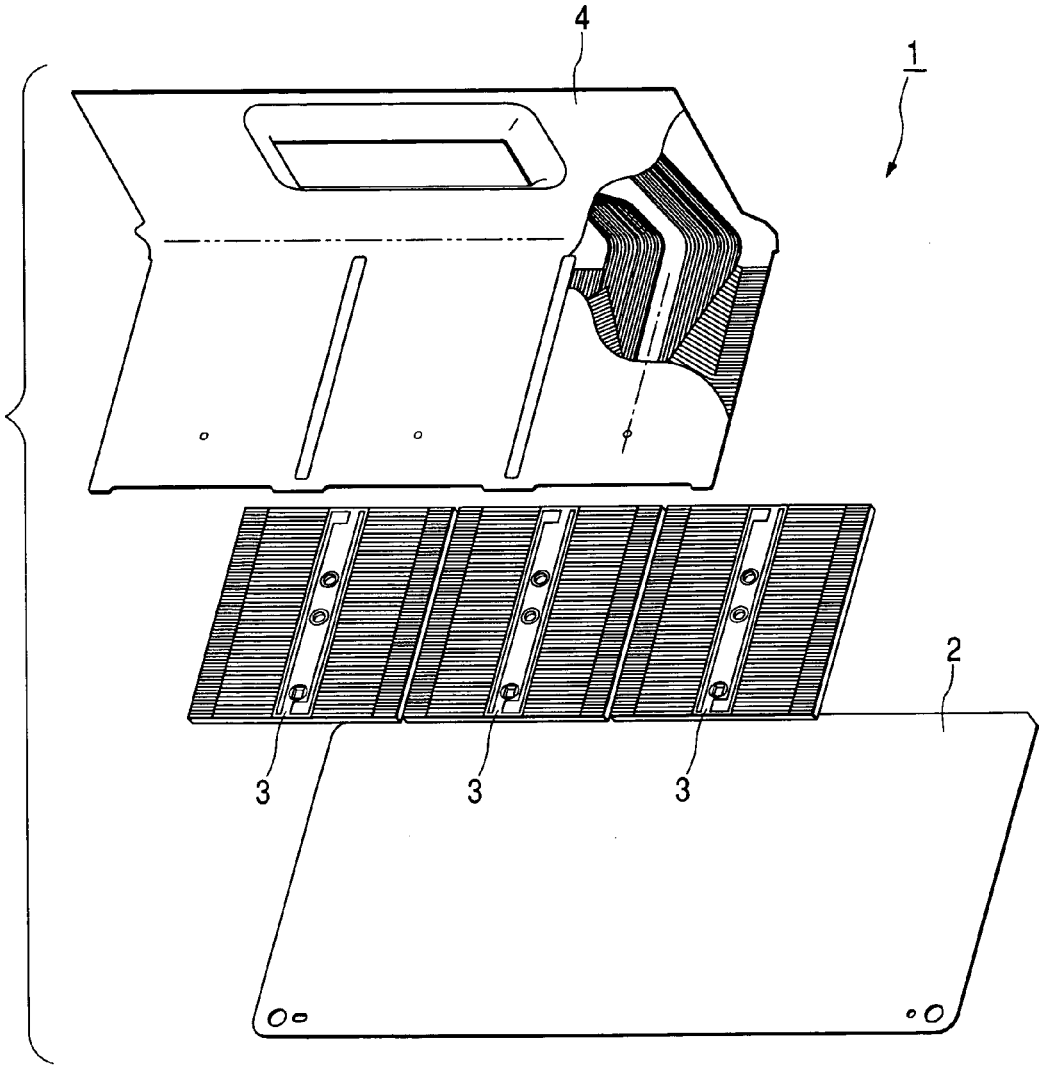
FIG. 1 is an exploded perspective view to show the configuration of a recording head according to one embodiment of the invention.

Referring now to the accompanying drawings, there will be described one preferred embodiment of the invention. In the description that follows, as a liquid jetting head, a recording head 1 installed in an image recording apparatus such as a printer or a plotter is taken as an example, as shown in FIG. 1. The recording head 1 is roughly made up of a flow passage unit 2, actuator units 3, and a film-like wiring board 4. The actuator units 3 are joined side by side on the surface of the flow passage unit 2, and the wiring board 4 is attached to the surfaces of the actuator units 3 on the opposite side to the flow passage unit 2.

Figure 7:
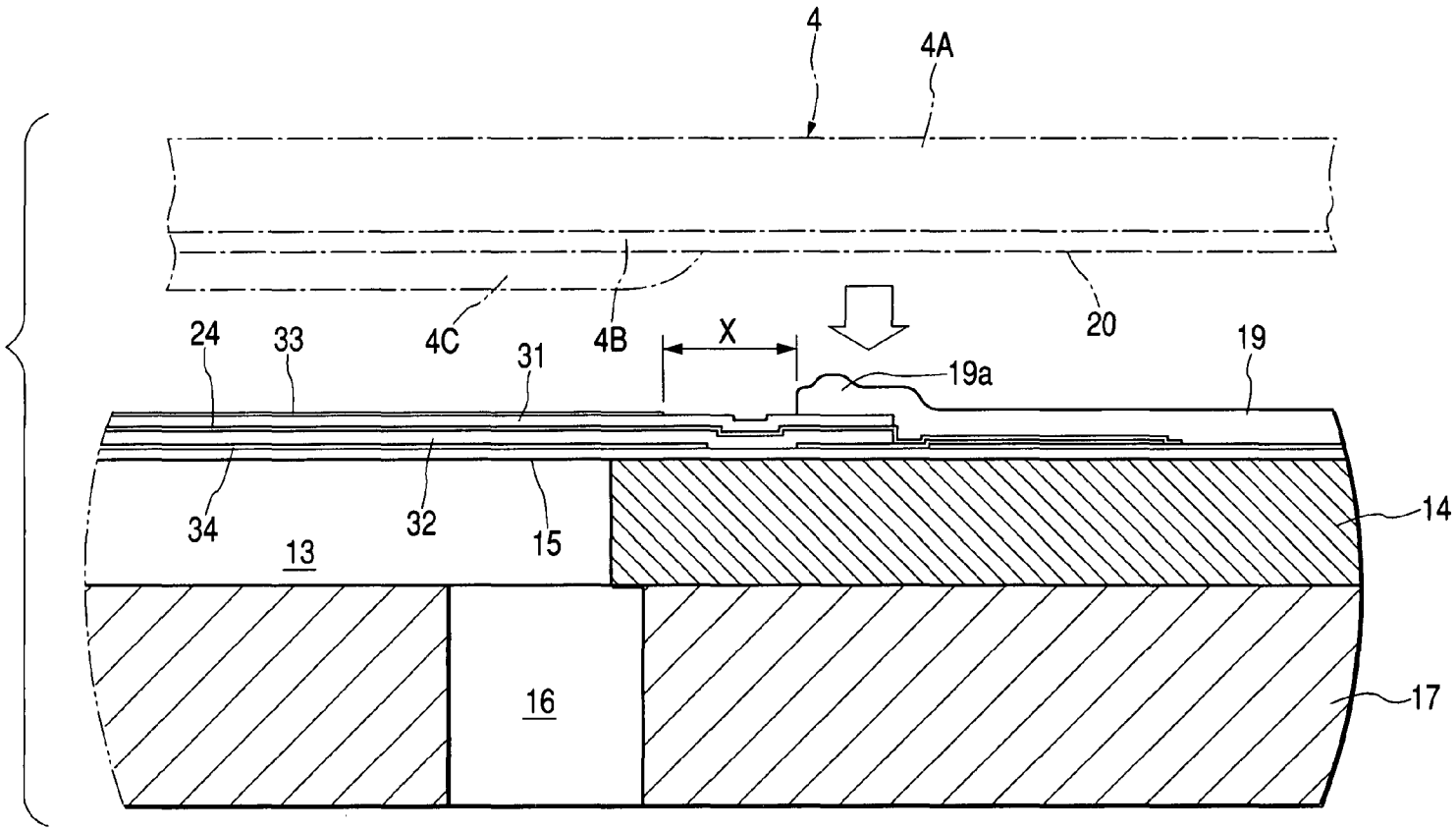
FIG. 7 is an enlarged view of A part in FIG. 6.

For example, as shown in FIG. 7, the wiring board 4 is formed with a conductor pattern 4B on the surface of a base film 4A and with a contact terminal 20 left, the conductor pattern 4B is covered with a resist 4C and thus the contract terminal 20 is soldered to a discrete terminal 19 (described later) for attaching the wiring board 4.

Figure 2:
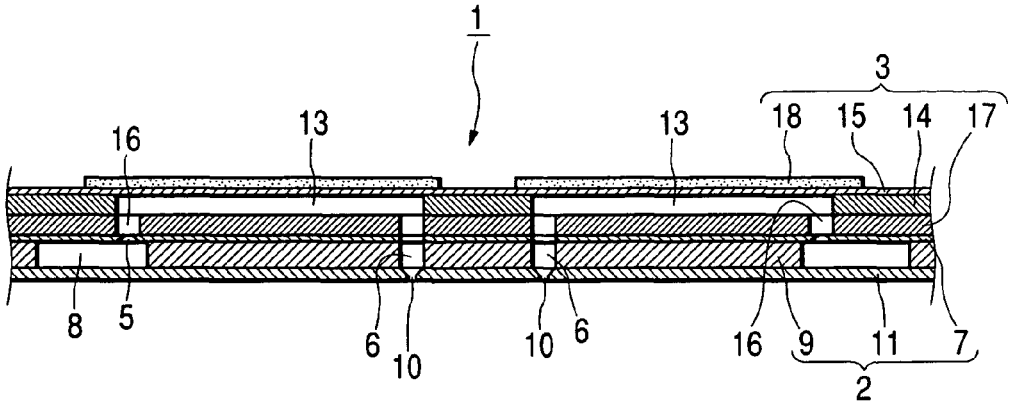
FIG. 2 is a sectional view to show an actuator unit and a flow passage unit in the recording head.

As shown in FIG. 2 (sectional view), the flow passage unit 2 is made up of a supply port formation substrate 7 formed with through holes used as a part of an ink supply port 5 and a part of each nozzle communication port 6, an ink chamber formation substrate 9 formed with through holes used as a common ink reservoir 8 and a part of each nozzle communication port 6, and a nozzle plate 11 having nozzle orifices 10 arranged in a subscanning direction. The supply port formation substrate 7, the ink chamber formation substrate 9, and the nozzle plate 11 are produced by pressing a stainless steel plate material, for example.

FIG. 2 shows a part of the flow passage unit 2 corresponding to one actuator unit 3. In the embodiment, three actuator units 3 are joined to one flow passage unit 2 and therefore a total of three sets of the ink supply port 5, the nozzle communication ports 6, the supply port formation substrate 7, the common ink reservoir 8, etc., are formed in a one-to-one correspondence with the three actuator units 3.

To produce the flow passage unit 2, the nozzle plate 11 is placed on one surface of the ink chamber formation substrate 9 (the lower side in the figure) and the supply port formation substrate 7 is placed on an opposite surface of the ink chamber formation substrate 9 (the upper side in the figure) and the supply port formation substrate 7, the ink chamber formation substrate 9, and the nozzle plate 11 are joined, for example, with a sheet-like adhesive.

Figure 3:
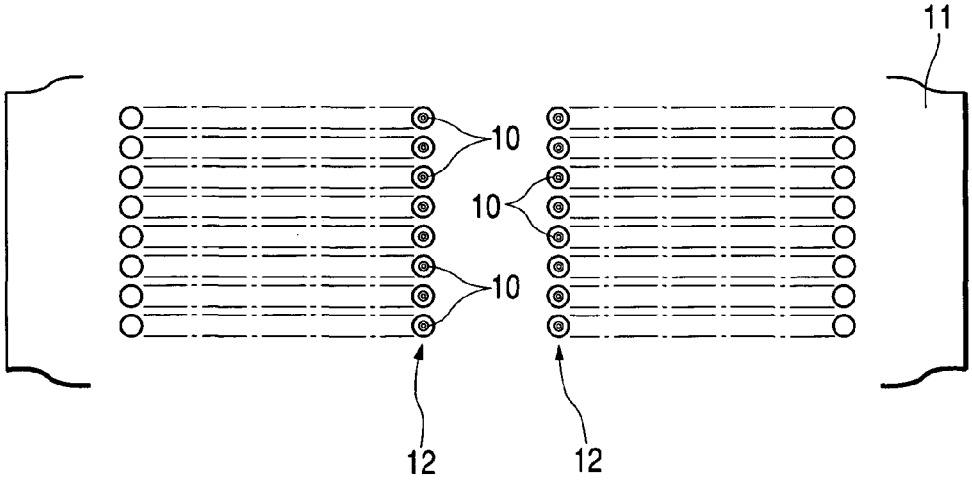
FIG. 3 is a partially enlarged view to show a nozzle plate in the recording head.

The nozzle orifices 10 are made like rows at predetermined pitches as shown in FIG. 3. The nozzle orifices 10 made like a row make up each nozzle row 12. For example, 92 nozzle orifices 10 make up one nozzle row 12. The two nozzle rows 12 are formed for one actuator unit 3. Thus, a total of six nozzle rows 12 are formed side by side for one flow passage unit 2

The actuator unit 3 is also called a head chip and is one type of piezoelectric actuator. As shown in FIG. 2, the actuator unit 3 is made up of a pressure chamber formation substrate 14 formed with through holes used as pressure chambers 13, a vibration plate 15 for defining a part of each pressure chamber 13, a lid member 17 formed with through holes used as a supply communication port 16 and a part of each nozzle communication port 6, and piezoelectric vibrators 18. As for the plate thicknesses of the members, preferably each of the pressure chamber formation substrate 14 and the lid member 17 is 50 μm or more, more preferably 100 μm or more. Preferably, the vibration plate 15 is 50 μm or less, more preferably about 3 to 12 μm.

To produce the actuator unit 3, the lid member 17 is placed on one surface of the pressure chamber formation substrate 14 and the vibration plate 15 is placed on an opposite surface and the members are formed in one piece. That is, the pressure chamber formation substrate 14, the vibration plate 15, and the lid member 17 are made of ceramics of alumina, zirconium oxide, etc., and are baked and put into one piece.

For example, work of cutting, punching, etc., is performed on a green sheet (unbaked sheet member) to form necessary through holes, etc., for forming each sheet-like precursor of the pressure chamber formation substrate 14, the vibration plate 15, and the lid member 17. The sheet-like precursors are deposited on each other and are baked, whereby they are put into one piece to form one ceramic sheet. In this case, the sheet-like precursors are baked in one piece and therefore a special adhesion treatment is not required. A high sealing property can also be provided on the joint faces of the sheet-like precursors.

One ceramic sheet is formed with pressure chambers 13, nozzle communication ports 6, etc., of a plurality of units. In other words, a plurality of actuator units (head chips) 3 are produced from one ceramic sheet. For example, a plurality of chip areas each to form one actuator unit 3 are set like a matrix within one ceramic sheet. Necessary members of the piezoelectric vibrators 18, etc., are formed in each chip area and then the sheet-like member (ceramic sheet) is cut for each chip area, whereby a plurality of actuator units 3 are provided.

The pressure chambers 13 are each a hollow elongated in a direction orthogonal to the nozzle row 12 and are formed in a one-to-one correspondence with the nozzle orifices 10. That is, the pressure chambers 13 are placed like a row in the nozzle row direction, as shown in FIG. 3. Each pressure chamber 13 communicates at one end with the common ink reservoir 8 through the supply communication port 16 and the ink supply port 5. The pressure chamber 13 communicates at an opposite end to the supply communication port 16 with the corresponding nozzle orifice 10 through the nozzle communication port 6. Further, a part of the pressure chamber 13 (lower surface) is defined by the vibration plate 15.

The piezoelectric vibrators 18 are each a piezoelectric vibrator 18 in deflection vibration mode and are formed in a one-to-one correspondence with the pressure chambers 13 on the vibration plate surface opposite to the pressure chambers 13. The piezoelectric vibrator 18 is shaped like a block elongated in the longitudinal direction of the pressure chamber. It has a width roughly equal to that of the pressure chamber 13 and a length a little longer than that of the pressure chamber 13. Further, the piezoelectric vibrator 18 is disposed so that both end portions are beyond the end portions of the pressure chamber 13 in the longitudinal direction thereof.

Figure 4:
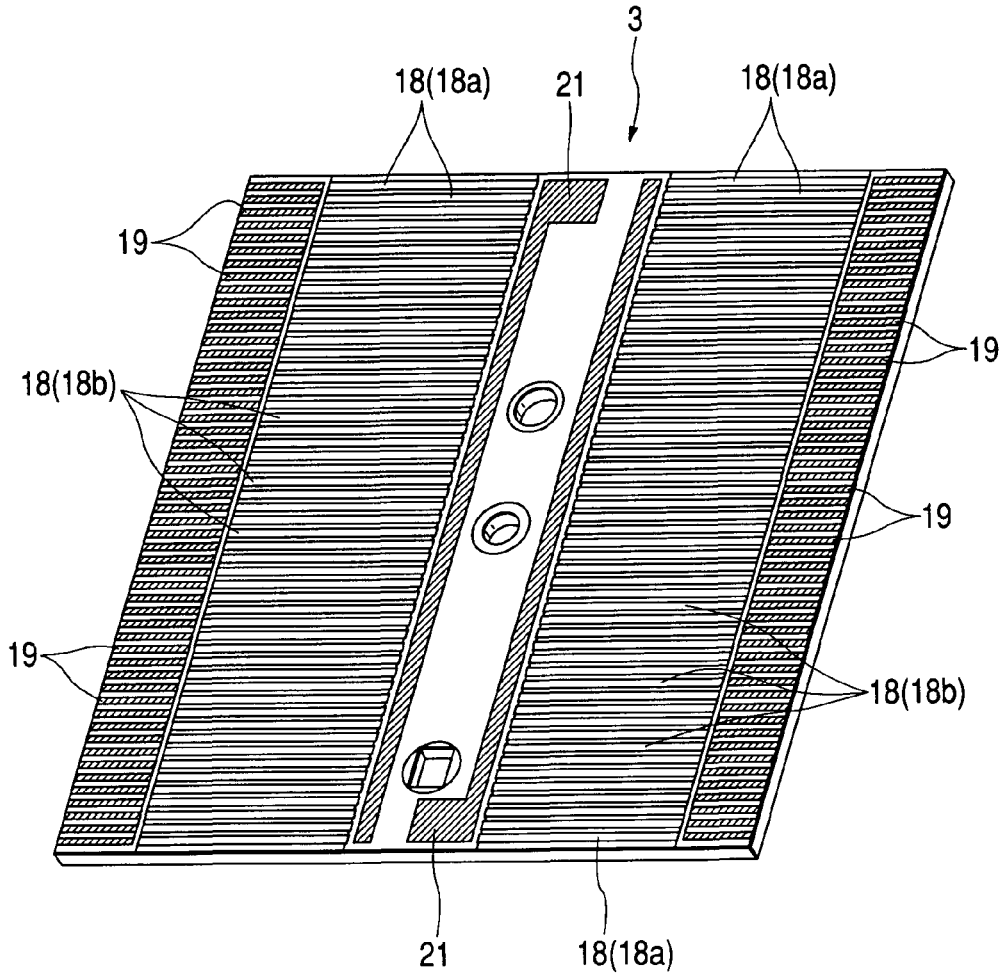
FIG. 4 is a perspective view of the actuator unit viewed from the side of a piezoelectric vibrator.

As shown in FIG. 4, the piezoelectric vibrators 18 are provided in a one-to-one correspondence with the pressure chambers 13 on the vibration plate surface opposite to the pressure chambers 13. That is, the piezoelectric vibrators 18 are arranged in the nozzle row direction. The piezoelectric vibrators 18 at the ends of each vibrator row are dummy vibrators 18*a* not involved in ejecting ink droplets (namely, not deformed because no drive signal is supplied). The piezoelectric vibrators 18 other than the dummy vibrators 18*a* serves as drive vibrators 18*b* involved in ejecting ink droplets (namely, deformed as a drive signal is supplied).

The discrete terminals 19 are provided in a one-to-one correspondence with the piezoelectric vibrators 18 on one side of the piezoelectric vibrators 18 (drive vibrators 18*b* and dummy vibrators 18*a*) in the longitudinal direction thereof. The above-mentioned contact terminals 20 of the wiring board 4 (see FIG. 7) are electrically connected to the discrete terminals 19. A linear proximal common electrode 21 forming a part of a common electrode is extended in the nozzle row direction on an opposite side of the piezoelectric vibrators 18 in the longitudinal direction thereof.

Figure 5:
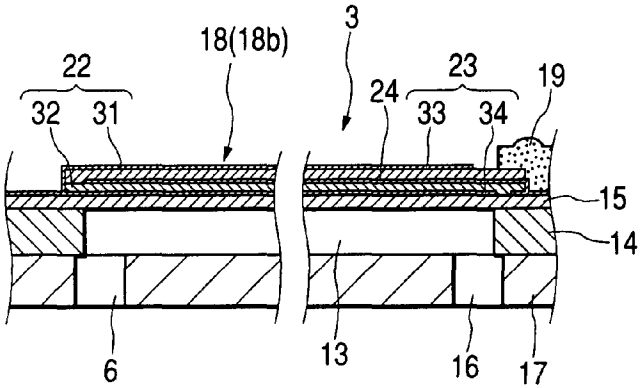
FIGS. 5 and 6 are sectional views to show the structure of the piezoelectric vibrator.

The piezoelectric vibrator 18 (drive vibrator 18*b*) in the embodiment has a multilayer structure including a piezoelectric layer 22, a branch common electrode 23, a drive electrode (discrete electrode) 24, etc., and the piezoelectric layer 22 is sandwiched between the drive electrode 24 and the branch common electrode 23, as shown in FIG. 5. A supply source (not shown) of a drive signal is electrically connected to the drive electrode 24 through the discrete electrode 19 while the branch common electrode 23 is adjusted to ground potential, for example, through the proximal common electrode 21, etc. When a drive signal is supplied to the drive electrode 24, an electric field of the strength responsive to the potential difference is generated between the drive electrode 24 and the branch common electrode 23. The electric field is given to the piezoelectric layer 22, which then becomes deformed in response to the strength of the given electric field.

That is, the higher the potential of the drive electrode 24, the more contracted the piezoelectric layer 22 in the direction orthogonal to the electric field, deforming the vibration plate 15 so as to reduce the volume of the pressure chamber 13. On the other hand, the lower the potential of the drive electrode 24, the more extended the piezoelectric layer 22 in the direction orthogonal to the electric field, deforming the vibration plate 15 so as to increase the volume of the pressure chamber 13.

The actuator unit 3 and the flow passage unit 2 are joined to each other. For example, a sheet-like adhesive is placed between the supply port formation substrate 7 and the lid member 17 and in this state, the actuator unit 3 is pressed against the flow passage unit 2, whereby the actuator unit 3 and the flow passage unit 2 are joined.

In the described recording head 1, ink flow passages each from the common ink reservoir 8 through the ink supply port 5, the supply communication port 16, the pressure chamber 13, and the nozzle communication port 6 to the nozzle orifice 10 are formed in a one-to-one correspondence with the nozzle orifices 10. At the operating time, the ink flow passage fills with ink. As the piezoelectric vibrator 18 is deformed, the corresponding pressure chamber 13 is contracted or expanded and pressure fluctuation occurs in ink in the pressure chamber 13. As the ink pressure is controlled, an ink droplet can be ejected from the nozzle orifice 10. For example, if the pressure chamber 13 of a stationary volume is once expanded and then rapidly contracted, the pressure chamber 13 is filled with ink as the pressure chamber 13 is expanded, and then the ink in the pressure chamber 13 is pressurized because of the later rapid contraction of the pressure chamber 13, ejecting an ink droplet. Further, as an ink droplet is ejected from the nozzle orifice 10, new ink is supplied from the common ink reservoir 8 into the ink flow passage, so that successively ink droplets can be ejected.

To execute high-speed recording, a larger number of ink droplets need to be ejected in a short time. To meet the requirement, it is necessary to consider compliance of the vibration plate 15 of the portion defining the pressure chamber 13 and the deformation amount of the piezoelectric vibrator 18. The reason why the compliance and the deformation amount need to be considered is that as the compliance of the vibration plate 15 increases, responsibility to the deformation worsens and it becomes difficult to drive at a high frequency and that as the compliance of the vibration plate 15 lessens, the vibration plate 15 becomes hard to deform and the shrinkage amount of the pressure chamber 13 lessens, decreasing the ink amount of one droplet.

In the embodiment, the piezoelectric vibrators 18 each of a multilayer structure are used to lessen the compliance of the vibration plate 15 and it is made possible to eject an ink droplet of the necessary amount at a higher frequency than ever. The end portions of the discrete terminals 19 are deposited on the piezoelectric vibrators 18 for miniaturizing the actuator unit 3 in the width direction thereof. Further, a connection electrode for electrically connecting the proximal common electrode 21 and the discrete electrode 19 is placed in each dummy electrode 18*a*. These points will be discussed below.

To begin with, the structure of the drive vibrator 18*b* will be discussed. As shown in FIG. 5, the piezoelectric layer 22 is formed like a block elongated in the longitudinal direction of the pressure chamber and is made up of an upper piezoelectric body (outer piezoelectric body) 31 and a lower piezoelectric body (inner piezoelectric body) 32 deposited on each other. The branch common electrode 23 is made up of an upper common electrode (outer common electrode) 33 and a lower common electrode (inner common electrode) 34. The branch common electrode 23 and the drive electrode 24 make up an electrode layer.

The term "upper (outer)" or "lower (inner)" mentioned here is used to indicate the position relationship with the vibration plate 15 as the reference. That is, the term "upper (outer)" is used to indicate the side distant from the vibration plate 15 and the term "lower (inner)" is used to indicate the side near to the vibration plate 15.

The drive electrode 24 is formed on the boundary between the upper piezoelectric body 31 and the lower piezoelectric body 32. The lower common electrode 34 and the upper common electrode 33 together with the proximal common electrode 21 make up the common electrode. That is, the common electrode is pectinated so as to form a plurality of branch common electrodes 23 (lower common electrode 34 and upper common electrode 33) extended from the proximal common electrode 21.

The lower common electrode 34 is formed between the lower piezoelectric body 32 and the vibration plate 15, and the upper common electrode 33 is formed on the surface of the upper piezoelectric body 31 on the opposite side to the lower piezoelectric body 32. That is, the drive vibrator 18*b* is of a multilayer structure wherein the lower common electrode 34, the lower piezoelectric body 32, the drive electrode 24, the upper piezoelectric body 31, and the upper common electrode 33 are deposited in order from the vibration plate 15 side.

In the embodiment, the piezoelectric layer 22 has a thickness of about 17 μm (the thickness of the upper piezoelectric body 31 plus the thickness of the lower piezoelectric body 32). The total thickness of the piezoelectric vibrator 18 including the branch common electrode 23 is about 20 μm. The related-art piezoelectric vibrator of the single-layer structure has a total thickness of about 15 μm. Therefore, as the thickness of the piezoelectric vibrator 18 increases, the compliance of the vibration plate 15 lessens accordingly.

The upper common electrode 33 and the lower common electrode 34 are adjusted to a constant potential, for example, ground potential regardless of a drive signal. The drive electrode 24 is changed in potential in response to the supplied drive signal. Therefore, as the drive signal is supplied, electric fields opposite in direction occur between the drive electrode 24 and the upper common electrode 33 and between the drive electrode 24 and the lower common electrode 34.

As materials forming the electrodes, various conductors of discrete metal, an alloy, a mixture of electric insulating ceramics and metal, and the like can be selected, but it is required that a defective condition of deterioration, etc., should not occur at the baking temperature. In the embodiment, gold is used for the upper common electrode 33 and platinum is used for the lower common electrode 34 and the drive electrode 24.

Both the upper piezoelectric body 31 and the lower piezoelectric body 32 are made of piezoelectric material consisting essentially of lead zirconate titanate (PZT), for example. The upper piezoelectric body 31 and the lower piezoelectric body 32 are opposite in polarization direction. Thus, the upper piezoelectric body 31 and the lower piezoelectric body 32 are identical in the extending or contracting direction when the drive signal is applied, and can deform the vibration plate 15 without a hitch. That is, as the potential of the drive electrode 24 is made higher, the upper piezoelectric body 31 and the lower piezoelectric body 32 deform the vibration plate 15 so as to lessen the volume of the pressure chamber 13; as the potential of the drive electrode 24 is made lower, the upper piezoelectric body 31 and the lower piezoelectric body 32 deform the vibration plate 15 so as to increase the volume of the pressure chamber 13.

Next, the structure of one side (common ink reservoir 8 side) of the drive vibrator 18*b* will be discussed.

On the one side, the discrete terminal 19 is formed as described above. The discrete terminal 19 of the drive vibrator 18*b* is a drive potential supply terminal for supplying a drive signal (drive potential), and is electrically connected to the contact terminal 20 of the wiring board 4. The discrete terminal 19 is electrically connected to the drive electrode 24 extended in the longitudinal direction of the pressure chamber 13. That is, a part of the discrete terminal 19 is deposited on an end portion of the drive electrode 24.

The embodiment is characterized by the fact that the end portion of the discrete terminal 19 is overlaid on the surface of the vibrator end portion (upper piezoelectric body) which is not superposed on the pressure chamber 13, and further the discrete terminal 19 is formed away from the upper common electrode 33 (branch common electrode 23).

Figure 6:
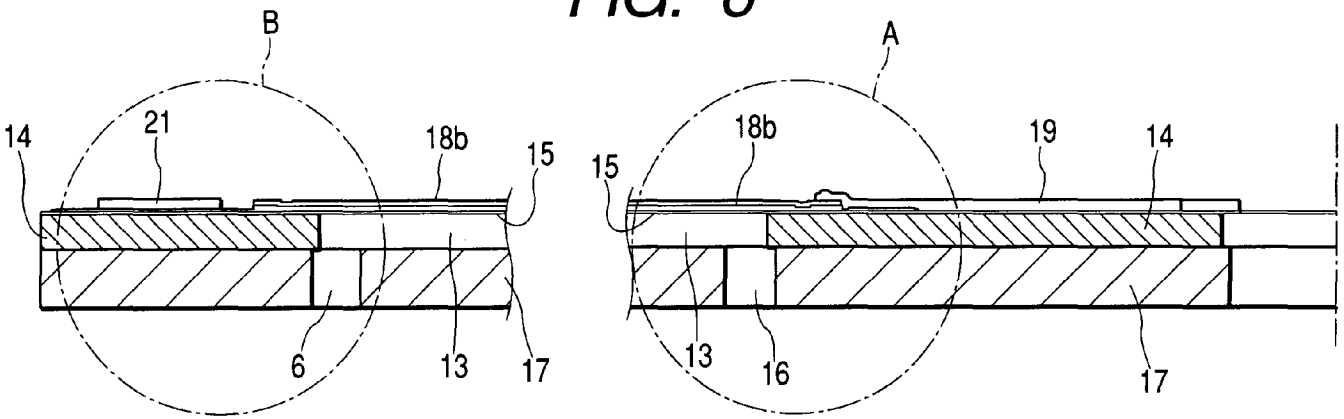

That is, as shown in FIGS. 6 and 7, the one end portion of the piezoelectric vibrator 18 is extended beyond the end portion of the pressure chamber 13, in other words, to a non-superposition area outside the superposition area on the pressure chamber 13. The vibrator-side end portion of the discrete terminal 19 is deposited on the upper surface of the piezoelectric vibrator 18 in the non-superposition area. The end portion of the discrete terminal 19 formed on the piezoelectric vibrator 18 becomes an electric connection (conduction) part with the wiring board 4 (contact terminal 20), which will be hereinafter also called conduction part 19*a*. On the other hand, the end portion of the upper common electrode 33 is formed to a point before the discrete terminal 19, but an isolation area X from the discrete terminal 19 is provided and therefore they are not electrically connected.

Such a structure makes it possible to miniaturize the actuator unit 3. That is, the end portion of the discrete terminal 19 is positively overlaid on the surface of the piezoelectric vibrator 18, so that the discrete terminal 19 can be formed leaning to the piezoelectric vibrator side as a whole. Thus, as for the discrete terminal 19, while the length required for electric connection (namely, the necessary length for joint to the contact terminal 20) is ensured, the width of the actuator unit 3, particularly, the width in the longitudinal direction of the pressure chamber can be shortened.

As the actuator unit 3 is miniaturized, at the manufacturing time, a larger number of actuator units 3 can be laid out on a ceramic sheet of the same area as the ceramic sheet in the related art. Therefore, in a case where the same process as that in the related art is applied, a larger number of actuator units 3 can be manufactured so that the manufacturing efficiency can be improved. The raw material can also be saved. Since the manufacturing efficiency can be improved and the raw material can be saved, cost reduction in the actuator unit 3 is also made possible.

At the connecting time to the wiring board 4, with the contact terminal 20 of the wiring board 4 put on the discrete terminal 19, a heating terminal (not shown) is pressed from the wiring board surface on the opposite side to the discrete terminal 19 for soldering the discrete terminal 19 and the contact terminal 20, as shown in FIG. 7. In this case, the conduction part 19*a* of the discrete terminal 19 is positioned above the piezoelectric vibrator 18 and is at the highest position in the actuator unit 3 and therefore is most strongly pressurized by the heating terminal. Thus, reliable soldering can be accomplished.

Further, the conduction part 19*a* is formed on the piezoelectric vibrator 18 and thus the member below the conduction part 19*a* is thickened as much as the piezoelectric vibrator 18, so that the member is enhanced in rigidity and can also receive reliably the press force from the heating terminal.

Next, the structure of an opposite side (nozzle orifice 10 side) of the drive vibrator 18*b* will be discussed.

Figure 8:
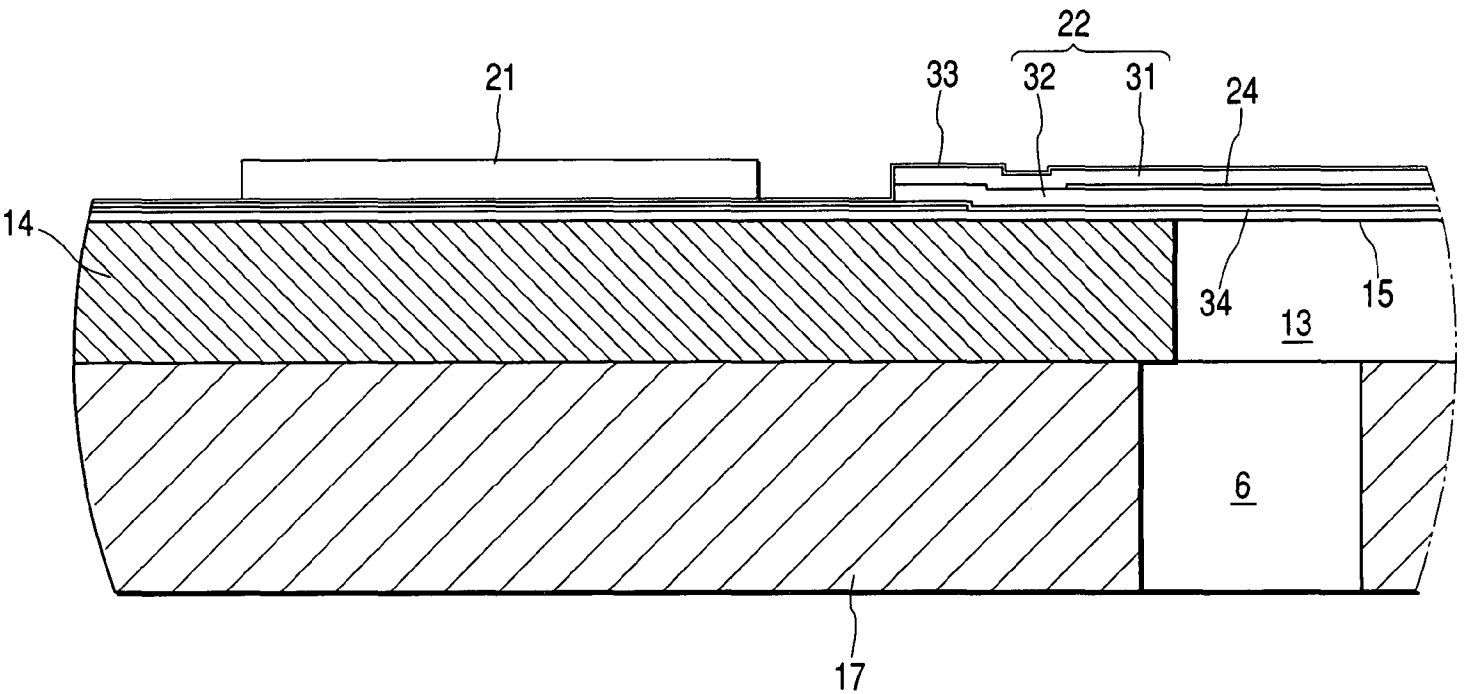
FIG. 8 is an enlarged view of B part in FIG. 6.

As shown in FIGS. 6 and 8, on the opposite side of the drive vibrator 18*b*, the upper common electrode 33 and the lower common electrode 34 are extended in the longitudinal direction of the pressure chamber 13. That is, the lower common electrode 34 is formed through the top of the vibrator plate 15 to the lower face of the proximal common electrode 21. The upper common electrode 33 is formed through a side end face of the piezoelectric layer 22 to the surface of the lower common electrode 34. Further, the upper common electrode 33 is also formed to the lower face of the proximal common electrode 21. Therefore, both the upper common electrode 33 and the lower common electrode 34 are electrically connected to the proximal common electrode 21.

Figure 9:
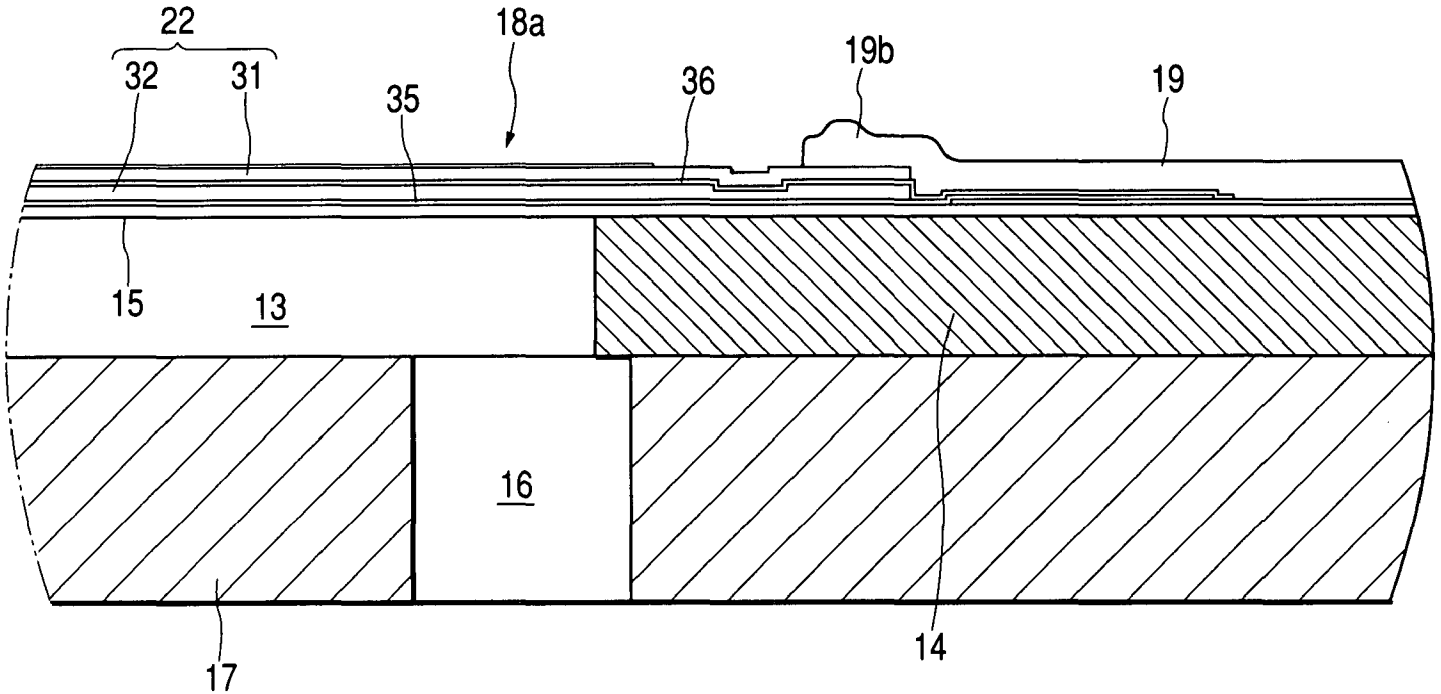
FIG. 9 is a drawing to show the structure of one end portion of a dummy vibrator of the recording head.
Figure 10:
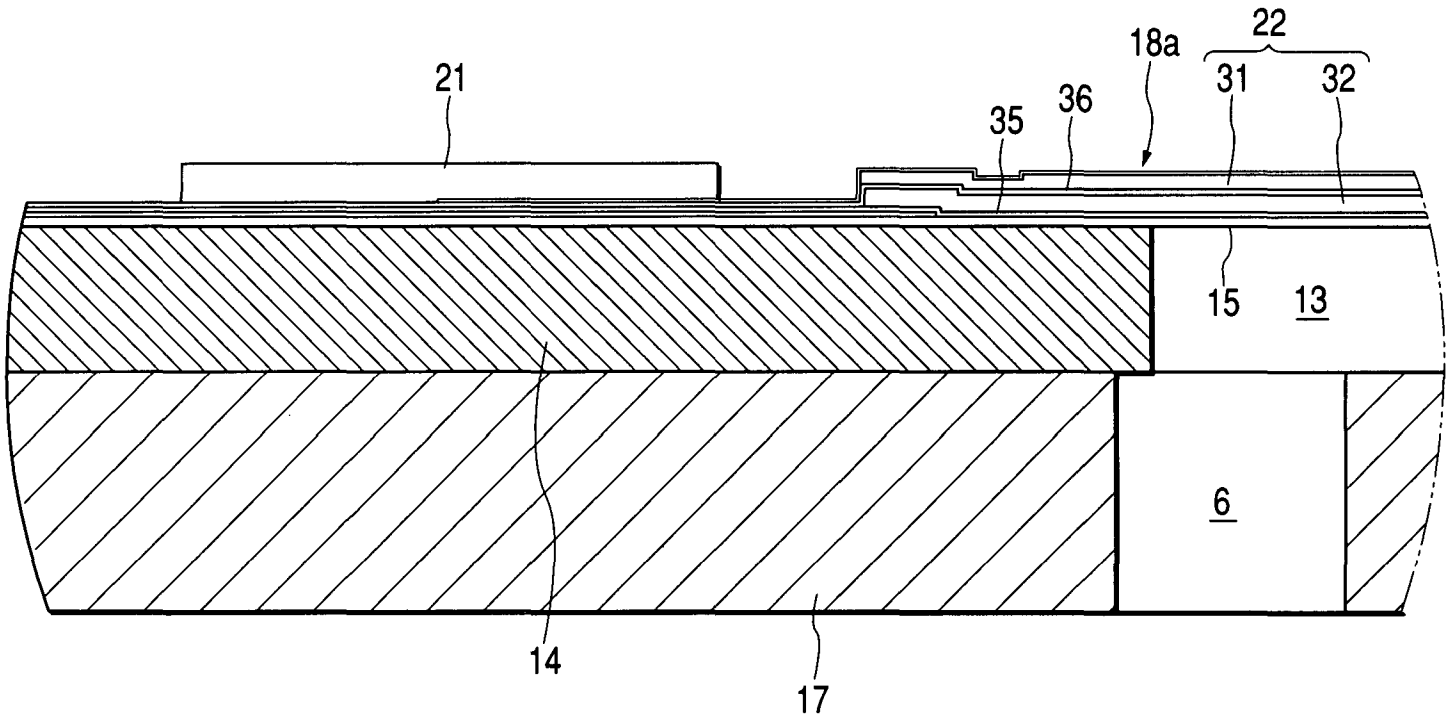
FIG. 10 is a drawing to show the structure of the other end portion of the dummy vibrator.

Next, the structure of the dummy electrode 18*a* will be discussed. The basic structure of the dummy electrode 18*a* is the same as that of the drive vibrator 18*b* described above. That is, as shown in FIGS. 9 and 10, the dummy electrode 18*a* also has a piezoelectric layer 22 including an upper piezoelectric body 31 and a lower piezoelectric body 32 and formed like a block elongated in the pressure chamber longitudinal direction and is formed with an electrode layer between the vibration plate 15 and the lower piezoelectric body 32, an electrode layer on the boundary between the upper piezoelectric body 31 and the lower piezoelectric body 32, and an electrode layer on the surface of the upper piezoelectric body 31 opposite to the lower piezoelectric body 32.

In the embodiment, the electrode layer between the vibration plate 15 and the lower piezoelectric body 32, which will be hereinafter referred to as a first connection electrode 35, and the electrode layer on the boundary between the upper piezoelectric body 31 and the lower piezoelectric body 32, which will be hereinafter referred to as a second connection electrode 36, are extended to both sides in the longitudinal direction of the pressure chamber 13 for electrically connecting the proximal common electrode 21 and the discrete terminal 19.

That is, the first connection electrode 35 is formed from the proximal common electrode 21 through the lower side of the lower piezoelectric body 32 to the discrete terminal 19, and the second connection electrode 36 is formed from the proximal common electrode 21 through the lower side of the upper piezoelectric body 31 to the discrete terminal 19. In the embodiment, the connection electrodes are formed with the same electrode material as the lower common electrode 34 and the drive electrode 24.

In the structure, the discrete terminal 19 provided on the dummy electrode 18*a* and the proximal common electrode 21 are electrically connected through the connection electrodes 35, 36, so that the discrete terminal 19 can be used as a supply terminal to supply common potential (for example, ground potential). Since the discrete terminal 19 is formed in the same row as the discrete terminal 19 for the drive vibrator 18*b*, the actuator unit 3 can be miniaturized. To electrically connect the wiring board 4 and each discrete terminal 19, the discrete terminal 19 for the dummy vibrator 18*a* and the discrete terminal 19 for the drive vibrator 18*b* can be electrically connected collectively, so that the work efficiency can be improved.

The connection electrodes are placed on the lower side of the piezoelectric layer 22, no burr-like parts occur. Thus, defective conditions of breaking or short-circuiting the wiring due to a burr-like part after the wiring board 4 is mounted can be prevented reliably. Therefore, full use of the stable performance of the recording head 1 with less trouble can be made.

Further, the connection electrodes 35 and 36 are separated into two layers and thus a sufficient thickness can be ensured, so that the resistance value of the electrode can be suppressed to a low value. In addition, the connection electrodes 35 and 36 are formed with the same electrode material as the lower common electrode 34 and the drive electrode 24 and thus can be manufactured at the same time as the lower common electrode 34 and the drive electrode 24. That is, the first connection electrode 35 can be manufactured at the same time as the lower common electrode 34, and the second connection electrode 36 can be manufactured at the same time as the drive electrode 24. This eliminates the need for executing the specific process for forming the connection electrodes, and the manufacturing efficiency can be enhanced.

It is to be understood that the invention is not limited to the specific embodiment and the combination and arrangement of parts may be resorted to without departing from the spirit and the scope of the invention as claimed.

For example, in the embodiment, the piezoelectric vibrator 18 is of the multilayer structure wherein the upper and lower piezoelectric bodies 31 and 32 and the like are deposited, but the invention can also be applied to the piezoelectric vibrator of a single-layer structure including a single layer of piezoelectric layer. For example, for the drive vibrator 18*b*, the drive electrode 24 is formed between the piezoelectric layer 22 and the vibration plate 15, and the upper common electrode 33 and the discrete electrode 19 are formed on the piezoelectric layer surface opposite to the vibration plate 15. For the dummy vibrator 18*a*, the connection electrode is formed between the piezoelectric layer 22 and the vibration plate 15.

Although the liquid jetting head has been described by taking the recording head 1, one type of liquid jetting head, as an example, the invention can also be applied to other liquid jetting heads such as a liquid crystal jetting head and a color material jetting head.

What is claimed is:

1. A liquid jetting head, comprising:

a vibration plate, which forms a part of a pressure chamber communicated with a nozzle orifice from which a liquid droplet is ejected, the pressure chamber being defined by first edges extending in a first direction with a first dimension and second edges extending in a second direction substantially perpendicular to the first direction with a second dimension shorter than the first dimension;

a piezoelectric vibrator, disposed on the vibration plate so to oppose the pressure chamber in a third direction which is orthogonal to the first direction and the second direction, the piezoelectric vibrator comprising:

a drive electrode, disposed so as to oppose the pressure chamber in the third direction, while extending beyond a line opposing one of the second edges in the third direction;

a first piezoelectric layer, disposed so as to oppose the drive electrode in the third direction while extending beyond lines opposing the second edges in the third direction;

a first common electrode, disposed on an upper face of the first piezoelectric layer so as to oppose the drive electrode through the first piezoelectric layer in the third direction; and a drive terminal, electrically connected to the drive electrode to supply a drive signal thereto, wherein an end of the drive terminal is disposed on the upper face of the first piezoelectric layer so as to oppose the drive electrode through the first piezoelectric layer in the third direction, while being separated from the first common electrode.

2. The liquid jetting head as set forth in claim 1, wherein the piezoelectric vibrator further comprises:

a second common electrode, formed on the vibration plate and electrically connected to the first common electrode; and a second piezoelectric layer, interposed between the second common electrode and the drive electrode.

3. The liquid jetting head as set forth in claim 1, further comprising a wiring board mounted on an upper face of the first common electrode and an upper face of the drive terminal, wherein the wiring board comprises a contact terminal connected to the drive terminal at a portion where the drive terminal is situated on a first portion of the first piezoelectric layer.

* * * * *